US005973581A

United States Patent [19]

Jacquin et al.

[11] Patent Number: 5,973,581

[45] Date of Patent: Oct. 26, 1999

[54] STARTER MOTOR SWITCH COMPRISING A SEALING PARTITION

[75] Inventors: Pascal Jacquin, L'Isle d'beau; Claude Thevenon, Eyzin-Pinet, both of France

[73] Assignee: Valeo Equipements Electriques Moteur, Creteil, France

[21] Appl. No.: 09/149,394

[22] Filed: Sep. 8, 1998

[30] Foreign Application Priority Data

Sep. 9, 1997 [FR] France ..... 97 11278

[51] Int. Cl.[6] ..... H01F 7/16; H01F 7/08

[52] U.S. Cl. ..... 335/131; 335/126; 335/260

[58] Field of Search ..... 335/106, 126, 335/127, 131, 251, 255, 257, 259, 260, 264, 265, 273; 290/10, 18, 22, 27, 28, 36 R, 38 R, 48

[56] References Cited

U.S. PATENT DOCUMENTS 4,983,941 1/1991 Tanaka ..... 335/255
5,103,107 4/1992 Yamamoto et al. ..... 290/48

FOREIGN PATENT DOCUMENTS 196 31 448 2/1997 Germany .

OTHER PUBLICATIONS

French Search Report dated Apr. 27, 1998.

*Primary Examiner*—Michael L. Gellner
*Assistant Examiner*—Raymond Barrera
*Attorney, Agent, or Firm*—Morgan & Finnegan, L.L.P.

[57] ABSTRACT

The invention relates to a starter motor switch in which there are arranged a stationary magnetic core and a winding at the center of which a plunger moves to act on a rod, a portion of which carries a contact intended to establish contact between two terminals, of the type in which the stationary core delimits a chamber and a chamber and of the type in which the stationary core has a cavity in which a portion of the rod is accommodated, wherein it comprises a sealing partition comprising a transverse plate resting against the front face of the stationary core, which is extended by a rim which interacts in a sealed manner with the cover, and comprising a central part, the shape of which complements that of the central cavity with which it interacts in a sealed manner.

9 Claims, 1 Drawing Sheet

STARTER MOTOR SWITCH COMPRISING A SEALING PARTITION

BACKGROUND OF THE INVENTION

The present invention relates to a motor vehicle internal combustion engine starter motor switch.

More specifically, the invention relates to a switch for a motor vehicle starter motor, of the type comprising a casing in which there are arranged a stationary magnetic core and a winding at the centre of which a moving plunger moves axially to act on a moving control rod, a rear portion of which is guided in axial sliding in an axial hole in the stationary core, and a front portion of which carries a moving contact intended to establish electric contact between two stationary terminals which extend axially through a front cover which is crimped into the casing, of the type in which the stationary core delimits a rear chamber in which the moving plunger moves, and a front chamber in which the moving contact and the terminals are arranged, and of the type in which the front face of the stationary core has a cylindrical central cavity in which there is accommodated an intermediate portion of the control rod comprising an external radial collar against which a spring for retaining the moving contact bears axially and the rear part of which is of a shape that complements that of the bottom of the cavity which is extended by the hole for guiding the rod.

BRIEF SUMMARY OF THE INVENTION

The purpose of this switch is to establish electric contact between the two stationary terminals via the moving contact. However, the situation, may arise where this function can no longer be fulfilled.

This is because the starter motor switch is not always completely watertight and when the vehicle drives over a wet road surface splashes of water may get into the switch. What is more, given the position of the starter motor switch near to the engine, the temperature inside the starter motor is relatively high, generally close to 90° C. The combination of the heat and of the moisture within the switch has several drawbacks.

First of all, because of the heat and moisture, the parts made of copper become covered in a thin film of black oxide, one of the properties of which is that it is an insulator and which therefore prevents the various parts from making electric contact. The starter motor switch is then unusable.

Another consequence of the moisture is that the other metal parts such as, for example, the springs, washers, magnetic circuits, etc. become oxidized. The salts which result from the oxidation of these parts may impede and even prevent the movements of the moving contact and of its control rod, which will then no longer be able to fulfil its function correctly.

The ingress of water into the switch may take place at various points. Mostly, the ingress is via the region where the front cover is crimped to the front end of the switch casing. However, other water droplets may also enter the switch via the rear chamber of the plunger, particularly through the clearance there is between the plunger and the interior walls of the switch. The water particles then enter the front chamber of the switch along the control rod through the radial clearance there is between the control rod and the stationary core.

To solve the first part of the sealing problems, namely the sealing between the front cover and the casing of the switch, it is already known to employ a run of sealant on the crimping of the cover applied from the front part of the casing, or to use a rubber seal arranged either between the front cover and the casing, or between the front cover and the stationary core of the switch.

However, these devices are liable to degrade over time, particularly as a result of the differences in expansion coefficients between the materials of the various components, which differences may cause defects and deformations creating passages via which the water can infiltrate into the switch.

To solve the second part of the sealing problem, namely the problem of sealing between the two chambers of the switch, and more particularly to prevent the water from entering the chamber of the switch, solutions such as an O-ring fitted to the control rod have already been proposed.

However, these arrangements on the one hand slow down the movement of the control rod, and therefore hamper the movements of the moving contact and on the other hand cause damage to the seal, there being a risk that the particles that are the result of this wear will deteriorate the operation of the switch by getting between the stationary terminals and the moving contact and forming an insulating film preventing electric contact between the terminals being made.

In order to solve these various problems, the invention proposes a starter motor switch in which there are arranged a stationary magnetic core and a winding at the centre of which a plunger moves to act on a rod, a portion of which carries a contact intended to establish contact between two terminals, of the type in which the stationary core delimits a chamber and a chamber, and of the type in which the stationary core has a cavity in which a portion of the rod is accommodated, characterized in that it comprises a sealing partition between the two chambers comprising a transverse plate oriented radially, resting axially against the front face of the stationary core, which is extended at its periphery by an axial rim facing forwards at right angles to the plate which interacts in a sealed manner with a rear face of the front cover of the switch, and comprising a tubular central part which extends axially backwards and the shape of which complements that of the central cavity of the stationary core with which it interacts in a sealed manner.

In this way, the two main sources of water ingress into the switch are sealed, and the chamber of the moving contact is isolated from any ambient moisture.

According to other features,

- the front rim of the partition is force-fitted into a complementary housing of the front cover of the switch so as to provide an external radial seal between the chamber of the moving contact and the chamber of the plunger;
- the axial length of the rim of the sealing partition exceeds the depth of the housing so as to produce a seal by crushing the front edge of the rim;
- the tubular part of the sealing partition has a rear end in the shape of a cone frustum that complements the shape of the central cavity of the stationary core, on which the collar of the control rod rests axially to provide an internal radial seal between the chamber of the moving contact and the chamber of the plunger;
- the rear end of the tubular part of the sealing partition comprises an annular lip, the inside diameter of which is smaller than the outside diameter of a radial collar of the control rod which extends the rear end of the collar to provide a seal between the two chambers;
- the sealing partition is moulded from plastic;
- the sealing partition is made of the same plastic as the front cover of the switch so as to avoid defects that are due to expansion.

BRIEF DESCRIPTION OF THE DRAWINGS

Other features and advantages of the invention will become clear from reading the detailed description which follows, for an understanding of which reference will be made to the appended drawings, in which.

DETAILED DESCRIPTION OF THE INVENTION

Figure 1:
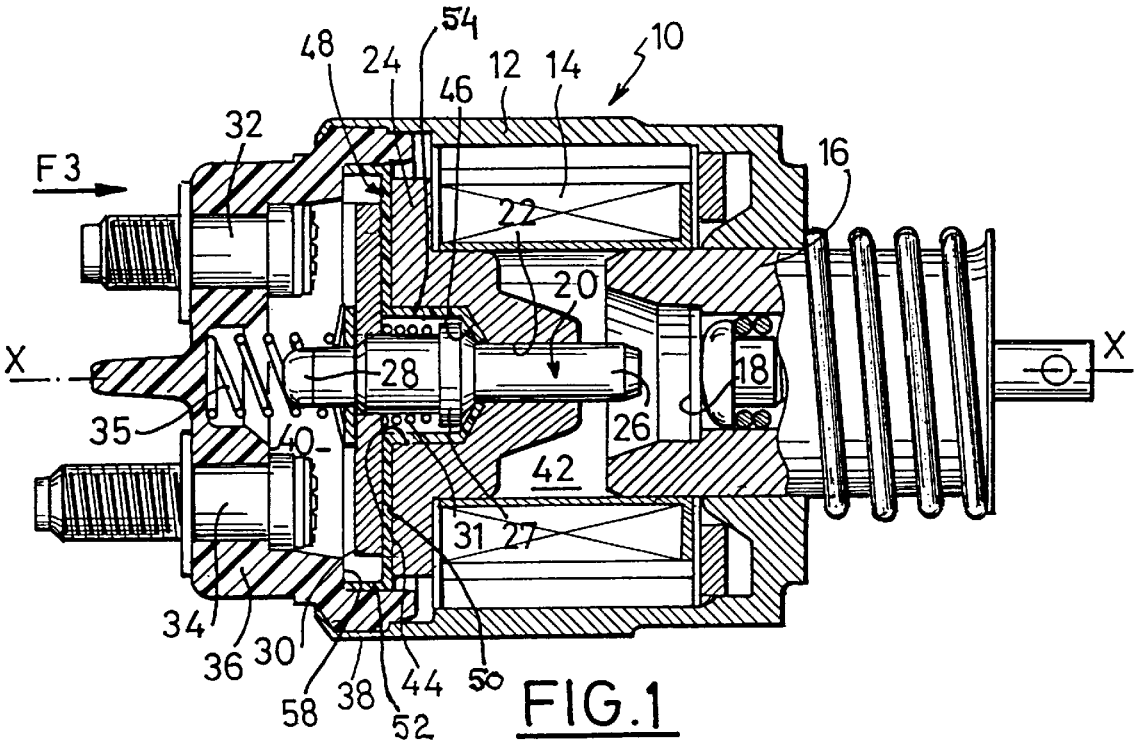
FIG. 1 is a view in longitudinal section of a starter motor switch with sealing means in accordance with the teachings of the invention.

In the description which follows, elements which are alike, similar or identical are denoted by the same reference numerals.

FIG. 1 depicts a switch 10 of a starter motor (not depicted) of a motor vehicle internal combustion engine.

This switch 10 comprises a metal casing 12 in which there are arranged windings 14. These windings 14 control the axial movement of a moving plunger 16, one end of which is connected to a pivoting lever (not depicted) which acts on the starter motor starter pinion. The other front end 18 of the moving plunger 16 acts on a control rod 20 in terms of thrust through a hole 22 in a stationary magnetic core 24 in which the rear part of the rod 20 is mounted so that it can slide axially.

The control rod 20 can therefore be pushed axially forwards by its rear portion 26 and on its opposite front portion 28 carries a moving contact 30 mounted to slide on the control rod 20.

The moving contact 30 is essentially in the shape of a rectangular plate and extends transversely to interact with two electric terminals 32 and 34 of the electric power circuit and to make electric contact between them. The two electric terminals 32 and 34 are stationary and are carried by a front cover 36, the annular rear edge of which is crimped into a front part 38 of the casing 12 of the switch 10.

The switch 10 also comprises a return spring 35, arranged inside the front cover 36, essentially between the contact terminals 32 and 34. This return spring 35 is used to push back the control rod 20 and therefore the moving contact 30 when the electric contact between the terminals 32 and 34 is to be interrupted, and when the control rod 20 is no longer pushed forwards by the moving plunger 16.

The control rod 20 also comprises an intermediate portion on which an external radial collar 27 is arranged. This radial collar 27 has a radial front face 29 against which a retaining spring 31 rests in order to urge the moving contact 30 towards the front of the control rod 20. The radial collar 27 also has a frustoconical rear face 33 which is inclined towards the axis of the rod.

The stationary core 24 delimits two chambers: a front chamber 40 in which the moving contact 30 and the electric terminals 32 and 34 are arranged, and a rear chamber 42 in which the moving plunger 16 moves axially.

The front face of the stationary core 24 has an axial cylindrical central cavity 44, the bottom of which opens into the hole 22 through which the control rod 20 passes. The hole 22 has a diameter smaller than that of the central cavity 44, and the transition between the hole 22 and the cavity 44 is provided by a frustoconical part 46 of the cavity 44, which is inclined backwards and towards the axis X—X of the switch 10.

In a conventional switch, the radial collar 27 of the control rod 20 rests axially at the rear on the inclined part 46 of the central cavity 44 of the stationary core 24 via its complementary frustoconical part 33. The inclinations of the inclined part 46 and of the rear face of the radial collar 27 are essentially the same so that the two elements can be in contact with one another over the largest possible area.

In accordance with the teachings of the invention, the switch 10 comprises an internal sealing partition 48.

Figure 2:
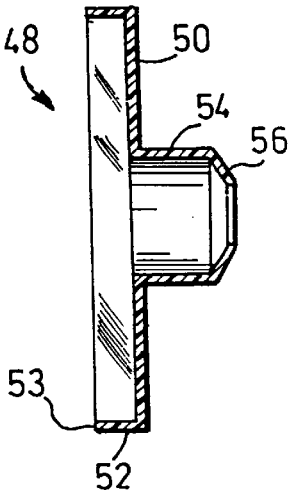
FIG. 2 is a view in longitudinal section of the sealing partition.
Figure 3:
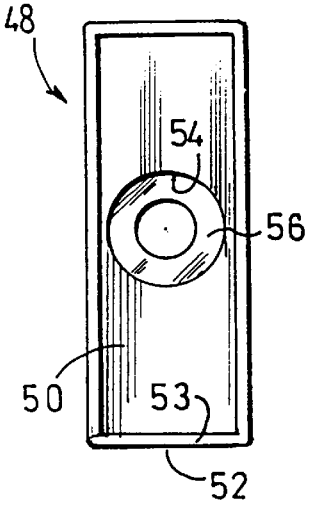
FIG. 3 is a front view of the sealing partition in the direction of arrow F3 of FIG. 1.
Figure 4:
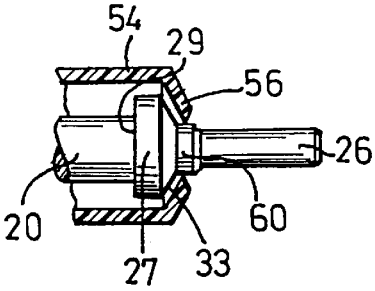
FIG. 4 is a sectional part view of the tubular central part of the partition, through which the control rod passes.

As can be seen more particularly in FIGS. 2 and 3, this sealing partition 48 comprises a transverse plate 50 oriented radially with respect to the axis X—X of the switch 10. The transverse plate 50 is extended at its periphery by an axial rim 52 facing forwards at right angles to the plate 50, and it comprises a tubular central part 54 which extends axially backwards. A rear end part 56 of the tubular central part 54 is inclined towards the axis, to define a section of frustoconical overall shape.

As can be seen in FIG. 1, the sealing partition 48 is placed in the switch 10 between the front cover 36 and the stationary core 24. The axial rim 52 of the partition 48 is arranged in a housing 58 of the rear face of the front cover 36 of the switch 10. Once fitted, the sealing partition 48 is fixed permanently to the front cover 36 by bonding, welding or crimping to prevent any ingress of water into the chamber 40 of the moving contact and thus provide external radial sealing.

The length of the rim 52 makes it possible to increase the area of contact between the rim 52 and the side walls of the housing 58, this further encouraging sealing between the chambers 40 and 42 and/or between the chamber 40 of the moving contact 30 and the outside of the switch 10.

According to another embodiment, the sealing partition 48 may be force-fitted into the housing 58. In this case, the axial length of the rim 52 may exceed the depth of the housing 58 in the front cover 36, and the front end 53 of the rim is slightly crushed against the bottom of the housing 58 as the sealing partition 48 is force-fitted, thus providing external radial sealing between the two chambers 40 and 42.

In order to limit the forces required to crush the front end 53 of the rim 52, this front end 53 may have a protruding crushing lip, which will be crushed more readily against the bottom of the housing 58, while at the same time providing a seal between the two chambers 40 and 42. This crushing lip may also be arranged in the bottom of the housing 58, to produce a seal between the chambers in the same way, by the crushing of the lip as the sealing partition 48 is force-fitted.

As can be seen more particularly in FIG. 1, the sealing partition 48 is arranged transversely in the chamber 40 of the moving contact 30, in contact with the front face of the stationary core 24.

The tubular part 54 of the sealing partition 48 is in contact with the walls of the cylindrical cavity 44 of the stationary core 24. In particular, the inclined rear-end part 56 of the sealing partition is in contact with the inclined part 46 of the cavity 44 of the stationary core 24 with which it interacts in a sealed manner.

The radial collar 27 of the control rod therefore rests, at the back, not in the known way on the stationary core 24, but this time on the inclined rear part 56 of the sealing partition 48 via its frustoconical part 33.

The internal radial seal between the chamber 40 of the moving contact 30 and the chamber 42 of the moving plunger 16 is provided by the inclined rear face 33 of the collar 27 of the control rod which rests on the inclined rear-end part 56 of the partition 48. The return spring 35 for the control rod 20 actually keeps this control rod firmly in the retracted position, and the radial collar 27 is therefore held against the partition 48, producing a seal.

According to another embodiment, the rear part 56 comprises a flexible annular lip, the inside diameter of which is smaller than the outside diameter of the radial collar 60 which extends the radial collar 27 of the control rod 20 backwards. The internal radial seal is thus improved, particularly for movements of the control rod 20. This is because when the latter is returned backwards to its position of rest by the return spring, the radial collar 60 moves the flexible annular lip elastically away from the sealing partition, preventing any water particles from getting into the chamber 40 of the switch.

The sealing partition 48 is made of plastic, this material having various advantages such as a low cost, a low weight for the partition, and can, with no problem, undergo the small deformations, particularly allow force-fitting, the deformation of the material producing the seal.

Advantageously, the sealing partition 48 is made of the same material as the front cover 36, so as to avoid problems caused by differences in expansion which may occur and which may cause deformations through which water can infiltrate.

We claim:

1. A switch for a motor vehicle starter motor, of the type comprising a casing in which there are arranged a stationary magnetic core and a winding at the center of which a moving plunger moves axially to act on a moving control rod, a rear portion of which is guided in axial sliding in an axial hole in the stationary core, and a front portion of which carries a moving contact intended to establish electric contact between two stationary terminals which extend axially through a front cover which is crimped into the casing, of the type in which the stationary core delimits a rear chamber in which the moving plunger moves, and a front chamber in which the moving contact and the terminals are arranged, and of the type in which the front face of the stationary core has a cylindrical central cavity in which there is accommodated an intermediate portion of the control rod comprising an external radial collar against which a spring for retaining the moving contact bears axially and the rear part of which is of a shape that complements that of the bottom of the cavity which is extended by the hole for guiding the rod, wherein it comprises a sealing partition between the two chambers comprising a transverse plate oriented radially, resting axially against the front face of the stationary core, which is extended at its periphery by an axial rim facing forwards at right angles to the plate which interacts in a sealed manner with a rear face of the front cover of the switch, and comprising a tubular central part which extends axially backwards and the shape of which complements that of the central cavity of the stationary core with which it interacts in a sealed manner.

2. A switch according to claim 1, wherein the front rim of the partition is force-fitted into a complementary housing of the front cover of the switch so as to provide an external radial seal between the chamber of the moving contact and the chamber of the plunger.

3. A switch according to claim 2, wherein the axial length of the rim of the sealing partition exceeds the depth of the housing so as to produce a seal; by crushing the front edge of the rim.

4. A switch according to claim 3, wherein the tubular part of the sealing partition has a rear end in the shape of a cone frustum that complements the shape of the central cavity of the stationary core, on which the collar of the control rod rests axially to provide an internal radial seal between the chamber of the moving contact and the chamber of the plunger.

5. A switch according to claim 2, wherein the tubular part of the sealing partition has a rear end in the shape of a cone frustum that complements the shape of the central cavity of the stationary core, on which the collar of the control rod rests axially to provide an internal radial seal between the chamber of the moving contact and the chamber of the plunger.

6. A switch according to claim 1, wherein the tubular part of the sealing partition has a rear end in the shape of a cone frustum that complements the shape of the central cavity of the stationary core, on which the collar of the control rod rests axially to provide an internal radial seal between the chamber of the moving contact and the chamber of the plunger.

7. A switch according to claim 6, wherein the rear end of the tubular part of the sealing partition comprises an annular lip, the inside diameter of which is smaller than the outside diameter of a second radial collar of the control rod which extends the rear end of the first collar to provide a seal between the two chambers.

8. A switch according to claim 1, wherein the sealing partition is moulded from plastic.

9. A switch according to claim 8, wherein the sealing partition is made of the same plastic as the front cover of the switch so as to avoid defects that are due to expansion.

* * * * *